US007607563B2

(12) United States Patent
Hanna et al.

(10) Patent No.: US 7,607,563 B2
(45) Date of Patent: Oct. 27, 2009

(54) PIZZA CONTAINER

(75) Inventors: D. Matt Hanna, Galesburg, MI (US); Robert A. Ford, Byron Center, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 0 days.

(21) Appl. No.: 11/894,454

(22) Filed: Aug. 21, 2007

(65) Prior Publication Data

US 2008/0048013 A1 Feb. 28, 2008

Related U.S. Application Data

(60) Provisional application No. 60/840,547, filed on Aug. 28, 2006.

(51) Int. Cl.
*B65D 43/14* (2006.01)

(52) U.S. Cl. ..... 229/112; 229/143; 229/148; 229/160.2; 229/906

(58) Field of Classification Search ..... 229/112, 229/143, 148, 160.2, 126, 128, 902, 906
See application file for complete search history.

(56) References Cited

U.S. PATENT DOCUMENTS

| | | | | |
|---|---|---|---|---|
| 1,880,191 | A | 10/1932 | Bigelow | |
| 2,784,900 | A | 3/1957 | Bauer | |
| 2,839,236 | A * | 6/1958 | Dunning | 229/148 |
| 2,885,842 | A * | 5/1959 | Boitel | 53/462 |
| 3,190,535 | A | 6/1965 | Nute | |
| 3,361,329 | A | 1/1968 | Fox | |
| 3,361,332 | A * | 1/1968 | Mason | 229/240 |
| 3,468,469 | A * | 9/1969 | Kossoff et al. | 229/143 |
| 3,524,580 | A | 8/1970 | Heyworth | |
| 3,623,650 | A | 11/1971 | Watts | |
| 3,669,341 | A | 6/1972 | Hughes | |
| 3,703,256 | A * | 11/1972 | Ross | 229/149 |
| 3,737,095 | A * | 6/1973 | Derauf | 229/232 |
| 4,304,353 | A | 12/1981 | Stollberg | |
| 4,471,902 | A * | 9/1984 | Skaggs | 229/143 |
| 4,753,348 | A * | 6/1988 | Patrick et al. | 206/449 |
| 4,804,136 | A | 2/1989 | Hall | |
| 4,809,908 | A * | 3/1989 | Keefe et al. | 229/150 |
| 5,056,710 | A * | 10/1991 | Ritter | 229/143 |
| 5,226,587 | A | 7/1993 | Eisman et al. | |
| 5,226,588 | A * | 7/1993 | Schramm et al. | 229/149 |
| 5,289,970 | A | 3/1994 | McClure | |
| 5,921,466 | A * | 7/1999 | Speese et al. | 229/902 |
| 6,386,441 | B2 | 5/2002 | Philips | |
| 2005/0274779 | A1 | 12/2005 | Kuhn et al. | |
| 2006/0131369 | A1 | 6/2006 | Oddo | |
| 2008/0142407 | A1 * | 6/2008 | Moore | 229/126 |

FOREIGN PATENT DOCUMENTS

GB 2 076 782 A 12/1981

OTHER PUBLICATIONS

Three photographs (A, B and C) "Sanfratello's Pizza" box (date unknown).

* cited by examiner

*Primary Examiner*—Gary E Elkins
(74) *Attorney, Agent, or Firm*—Flynn, Thiel, Boutell & Tanis, P.C.

(57) ABSTRACT

A container for use in transporting food, such as pizza, and formed from a foldable blank. The container incorporates therein a cut-out adjacent a top wall thereof which serves as a finger grip for opening the container.

7 Claims, 7 Drawing Sheets

PIZZA CONTAINER

CROSS-REFERENCE TO PRIOR APPLICATION

This application claims priority under 35 USC §119(e) of copending provisional application Ser. No. 60/840,547 filed Aug. 28, 2006, the entire disclosure of which is herein incorporated by reference.

FIELD OF THE INVENTION

This invention relates to an improved food container assembled from a foldable blank, and designed specifically for transport and storage of a food product, such as pizza.

BACKGROUND OF THE INVENTION

Containers constructed from a single-sheet of material, such as corrugated cardboard, and folded into a box form for transporting food and other objects are well-known. Such boxes are commonly used for storing and transporting pizza.

One example of such a container is disclosed in U.S. Pat. No. 4,804,136. This container includes a rectangular bottom wall, a pair of side walls and a pair of end walls joined to respective opposite pairs of edges of the bottom wall, and a pair of top covers which are joined to the respective end walls. The side walls have angled edges on which the end walls are engaged in the assembled configuration of the container, such that the end walls diverge towards one another as same project upwardly. Further, the top covers are foldable downwardly from the end walls and define slots which cooperate with locking tabs provided on the respective side walls so as to maintain the container in a closed configuration. These slots are diamond-shaped so as to allow venting of the heat generated by the food product.

Another known container for transporting pizza is similar to the above container of the '136 patent, but instead provides circular cut-outs approximately mid-height along each of the angled end walls to allow venting.

While each of the above-described containers would appear to work reasonably well for their intended purpose, neither of these containers incorporates therein an easily manipulatable structure which allows easy opening of the container by the user or consumer.

The invention as described herein relates to a container or box for carrying, transporting or storing food, such as pizza or the like. The container is formed by folding a one-piece blank, and includes a finger grip arrangement adjacent one top edge thereof which allows easy-opening of the container.

Other objects and purposes of the invention will be apparent to persons familiar with arrangements of this general type upon reading the following specification and inspecting the accompanying drawings.

Figure 1:
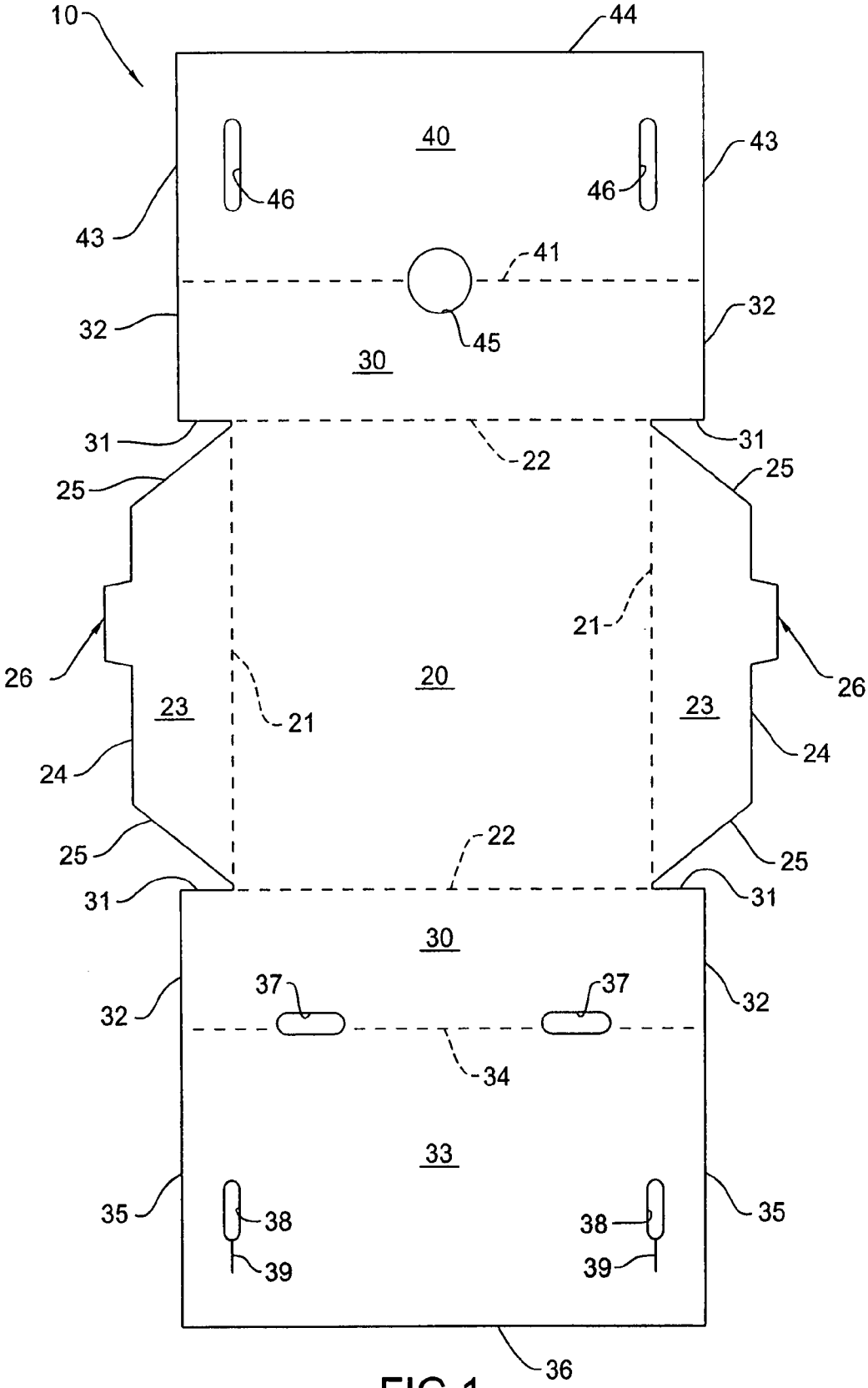
FIG. 1 is a plan view of an unfolded, flat, one-piece blank used for preparing the container according to the present invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the container or blank and designated parts thereof. Said terminology will include the words specifically mentioned, derivatives thereof, and words of similar import.

DETAILED DESCRIPTION

Referring to FIG. 1, the present invention is directed to a flat blank 10. The blank in one embodiment is constructed from stiff double-sided corrugated cardboard having a corrugated interior layer bonded between a pair of flat facing layers, which layers are of rather thin paper. However, it will be appreciated that the blank 10 may be constructed of other materials, such as single-sided corrugated cardboard having a corrugated layer bonded to a single flat facing layer, with the corrugated layer facing inwardly toward the food product. Further, the blank 10 may be constructed of a single layer of paper, commonly referred to as chip board. The blank 10 is prepared using techniques which are conventional and well known in the box-forming industry.

The blank 10 is foldable into the shape of a container or box 13 (FIG. 5) suitable for carrying a food product, such as pizza.

The blank 10 (FIG. 1) is a flat and generally planar, monolithic, one-piece element and defines a bottom wall or panel 20 which is generally rectangular in shape. Bottom panel 20 includes a pair of generally parallel first side edges 21 and a pair of generally parallel second side edges 22, the latter extending generally perpendicularly between the side edges 21. All of the side edges 20 and 21 are defined by fold lines, as shown in dotted lines in FIG. 1.

The blank 10 also includes a pair of elongated side walls 23 which join to opposite side edges 21 at the fold lines thereof. A free edge 24 of each side wall 23 extends generally parallel with the fold line 21, the latter defining the inner or lower edge of the side wall 23. Each side wall 23 defines a pair of beveled or angled free edges 25, the outer or upper edges of which join to opposite ends of free edge 24, and the inner or lower edges of which join to opposite ends of fold line 21. The angled edges 25 diverged towards one another as they project away from fold line 21. In the illustrated embodiment, each edge 25 is oriented at an angle of approximately 128° with the respective free edge 24. Tabs 26 project in a cantilevered fashion from free edge 24, and in the illustrated embodiment are located in an off-center location along edge 24.

A pair of end walls 30, generally rectangular in configuration, are joined to the opposite side edges 22 of bottom panel 20 through the respective fold lines. The innermost or lowermost edge of each end wall 30 is defined by the respective fold line 22, and each end wall 30 additionally includes a pair of inner or lower edges 31 which are coextensive with, and extend outwardly from opposite sides of the respective fold line 22. Each end wall 30 additionally includes a pair of side edges 32 which are generally parallel to one another, and which are also generally parallel to, but spaced outwardly from the respective side edges 21 of bottom panel 20.

One of the end walls 30 (the lower one in FIG. 1) is joined to a top flap 33 via a fold line 34, which fold line 34 is spaced outwardly from and is generally parallel to fold line 22. Top flap 33 is defined by a pair of side edges 35 which are coextensive with side edges 32 of end wall 30, and a free end edge 36 spaced outwardly from and generally parallel to fold line 34. A pair of elongated cut-outs or slots 37 are formed along fold line 34, and are disposed in sidewardly-spaced relation with one another. When container 13 is assembled, slots 37 serve as vent openings so as to allow escape of heat from the food product stored in container 13. Further, top flap 33 defines therein a pair of elongate cut-outs 38 disposed inwardly from, and in generally parallel relation with, the respective side edges 35. A straight cut or slot 39 extends outwardly from each cut-out 38 towards free end edge 36 for approximately one-half the length of the respective cut-out 38.

A top flap 40 is joined to the opposite end wall 30 through a fold line 41. Fold line 41 is generally parallel to and spaced outwardly from fold line 22. Top flap 41 is defined by a pair of side edges 43 which are coextensive with the respective side edges 32 of adjacent end wall 30, and a free end edge 44 spaced outwardly from and generally parallel to fold line 41. A generally circular cut-out 45 is disposed along fold line 41 approximately mid-way therealong. In the illustrated embodiment, cut-out 45 is substantially bisected by fold line 41. Further, top flap 40 defines therein a pair of elongated cut-outs or slots 46 disposed inwardly from and in generally parallel relation with the respective side edges 43.

The blank 10 will normally be maintained in the flat condition illustrated by FIG. 1, which facilitates compact shipping and storage thereof. When use is desired, the blank 10 may be assembled for the purpose of storing and transporting a food product as discussed in detail below.

To assemble the blank 10 into the container 13, the side walls 23 are initially manually folded upwardly about their respective fold lines 21, and the end walls 30 are folded upwardly about their respective fold lines 22. In this regard, the end walls 30 are folded upwardly and inwardly towards one another until each end wall 30 is supported on and engaged with the opposite adjacent angled edges 25 of the two side walls 23. The top flap 40 is then folded downwardly from the adjacent end wall 30 about its fold line 41, and the upright tabs 26 of side walls 23 are inserted into the respective slots 46 of top flap 40. The opposite top flap 33 is then folded downwardly from its adjacent end wall about its fold line 34, and the tabs 26 are inserted into the respective slots 38 and cuts or slits 39. It will be appreciated that the slits 39, which effectively constitute narrowed portions of their respective slots 38, serve to frictionally lock the top flap 33 in its closed and generally horizontal position to prevent inadvertent opening of the container 13, by gripping outermost portions of the respective tabs 26.

The overall width dimension of the respective end walls 30 and their adjoining top flaps 33 and 40 (the width dimension being defined generally parallel to fold lines 34 and 41) is somewhat greater than the width dimension of bottom panel 20 (as defined between its side edges 21). The above dimensions cause the edges 32, 35 and 43 of the top flaps and end walls to be disposed in sidewardly-outwardly spaced or overhanging relation with the respective side walls 23 in the folded configuration of the container 13, which may allow easier handling of the container 13.

Figure 2:
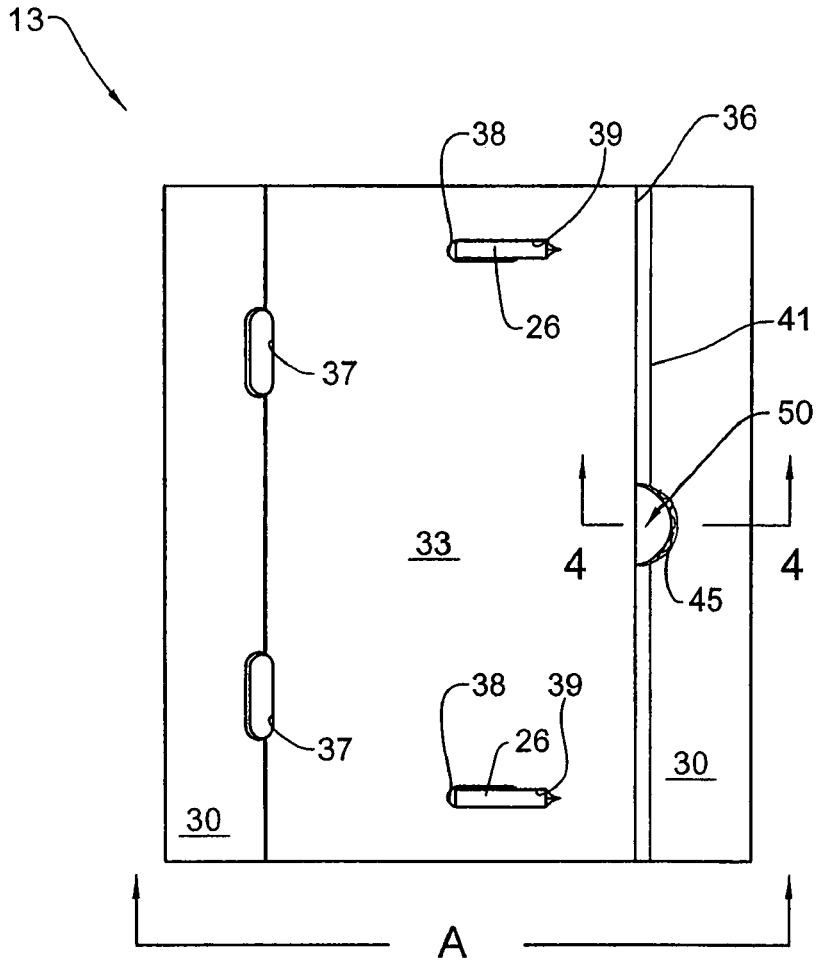
FIG. 2 is a plan view of the container in an assembled and closed configuration.
Figure 3:
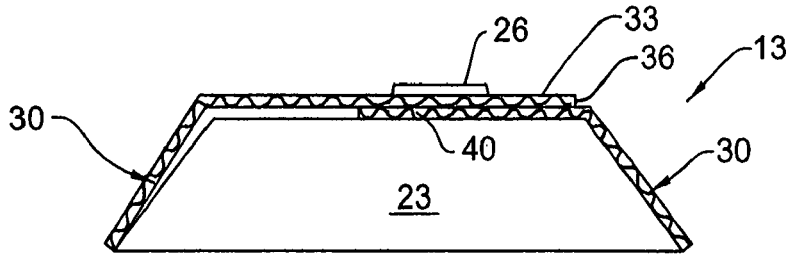
FIG. 3 is a side view as seen from direction A in FIG. 2.
Figure 4:
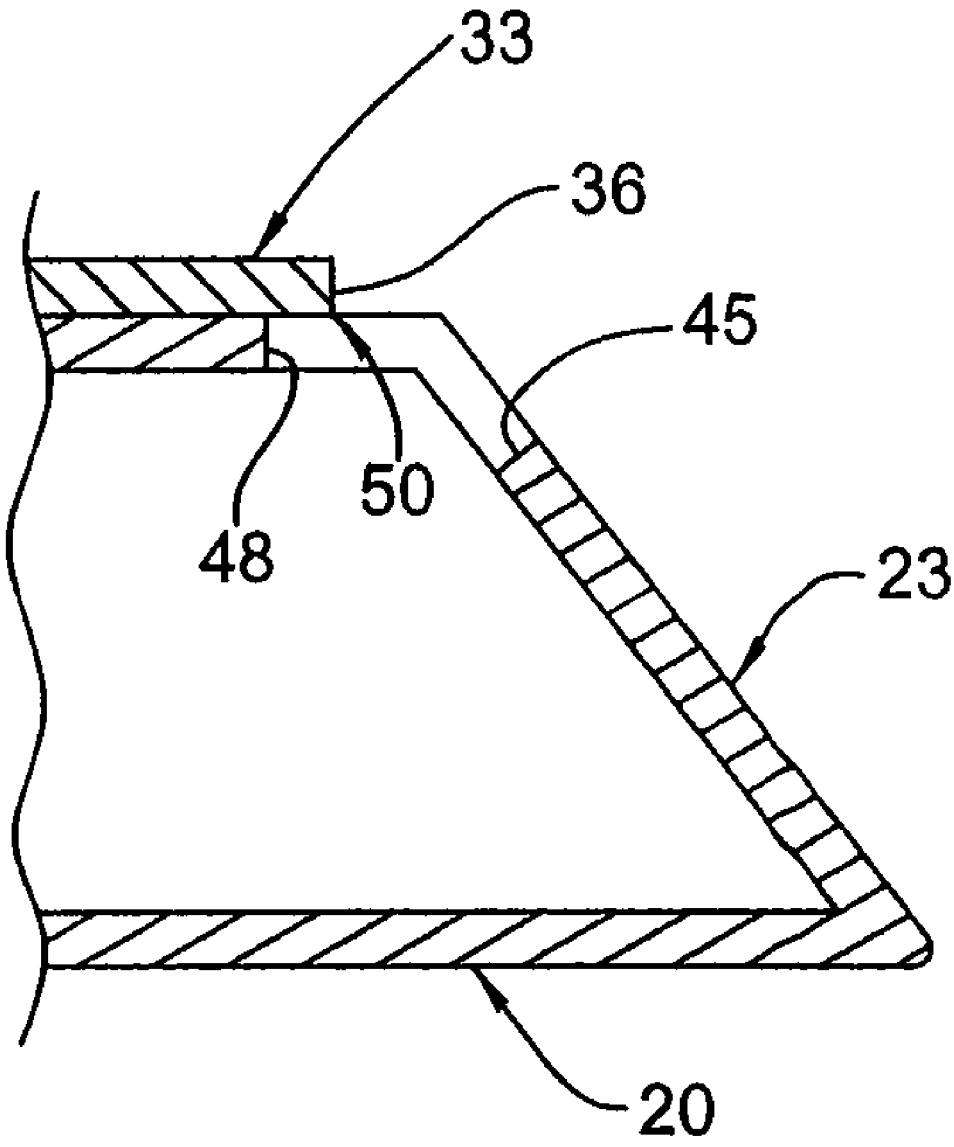
FIG. 4 is an enlarged, fragmentary and partial cross-sectional view taken generally along line 4-4 in FIG. 2.
Figure 5:
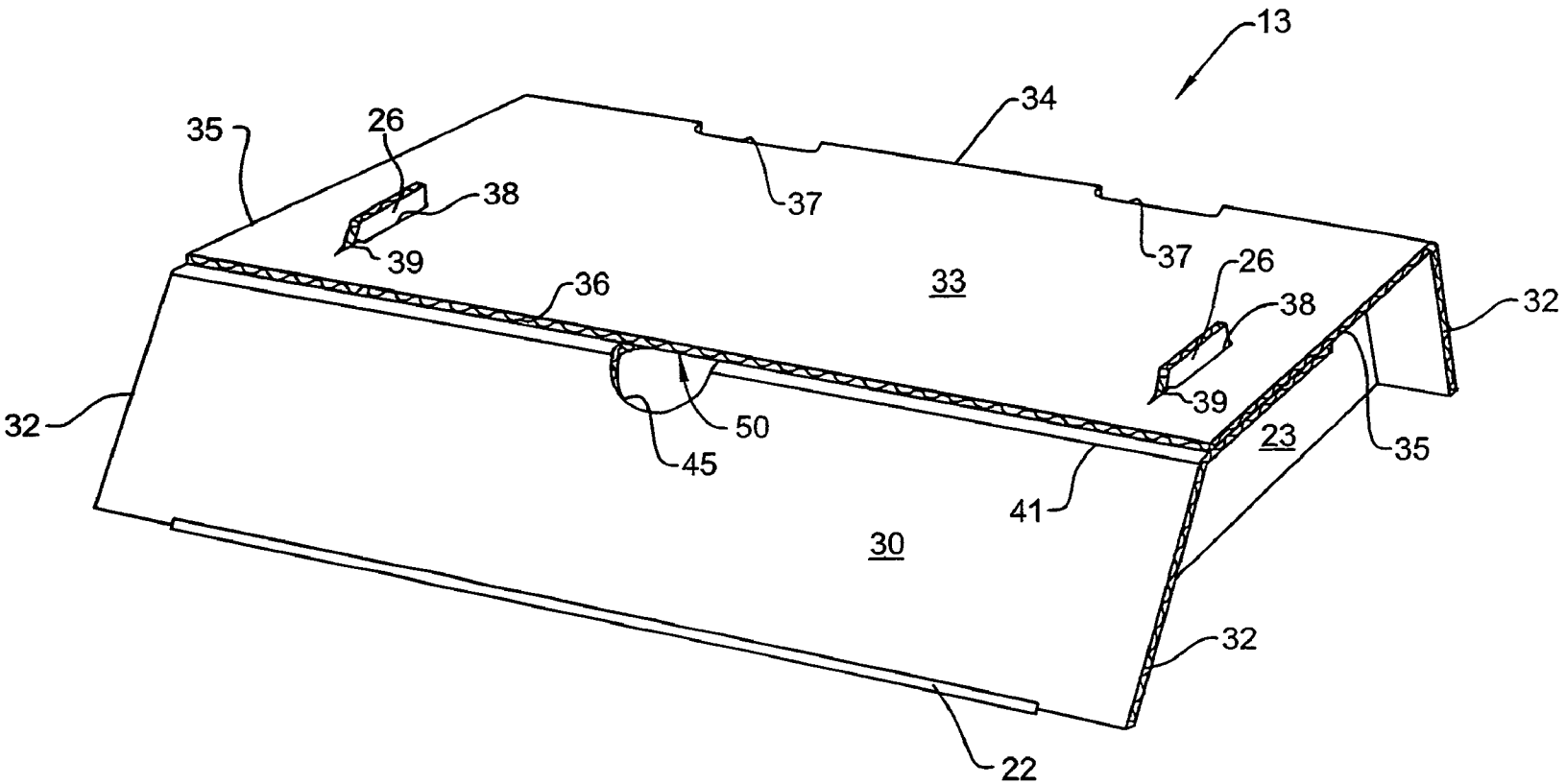
FIG. 5 is a perspective view of the container in an assembled and closed configuration.

With reference to FIGS. 2, 4 and 5, the top flap 33 in its closed position is superimposed over top flap 40. Further, top flap 33 is superimposed over a portion of cut-out 45 so as to block a portion of same. The cut-out 45 serves two purposes. Specifically, cut-out 45 serves as a vent, similar to cut-outs 37 located on the opposite fold line 34. Additionally, the free edge 36 of top flap 33 in the folded and closed configuration of the container 13 is spaced sidewardly outwardly (FIG. 4) from the innermost edge 48 of cut-out 45, and effectively serves as a finger grip so as to assist the user/consumer in opening the container 13. That is, to open the container 13, a finger is placed into the open portion of cut-out 45 and under free edge 36 of top flap 33. The top flap 33 is then lifted upwardly so as to open the container 13 and gain access to the opposite top flap 40. The exposed top flap 40 is then lifted upwardly to fully open the container 13. Thus, the cooperation between free edge 36 and cut-out 45 provides the container 13 with an easily accessible and usable finger grip 50.

Figure 6:
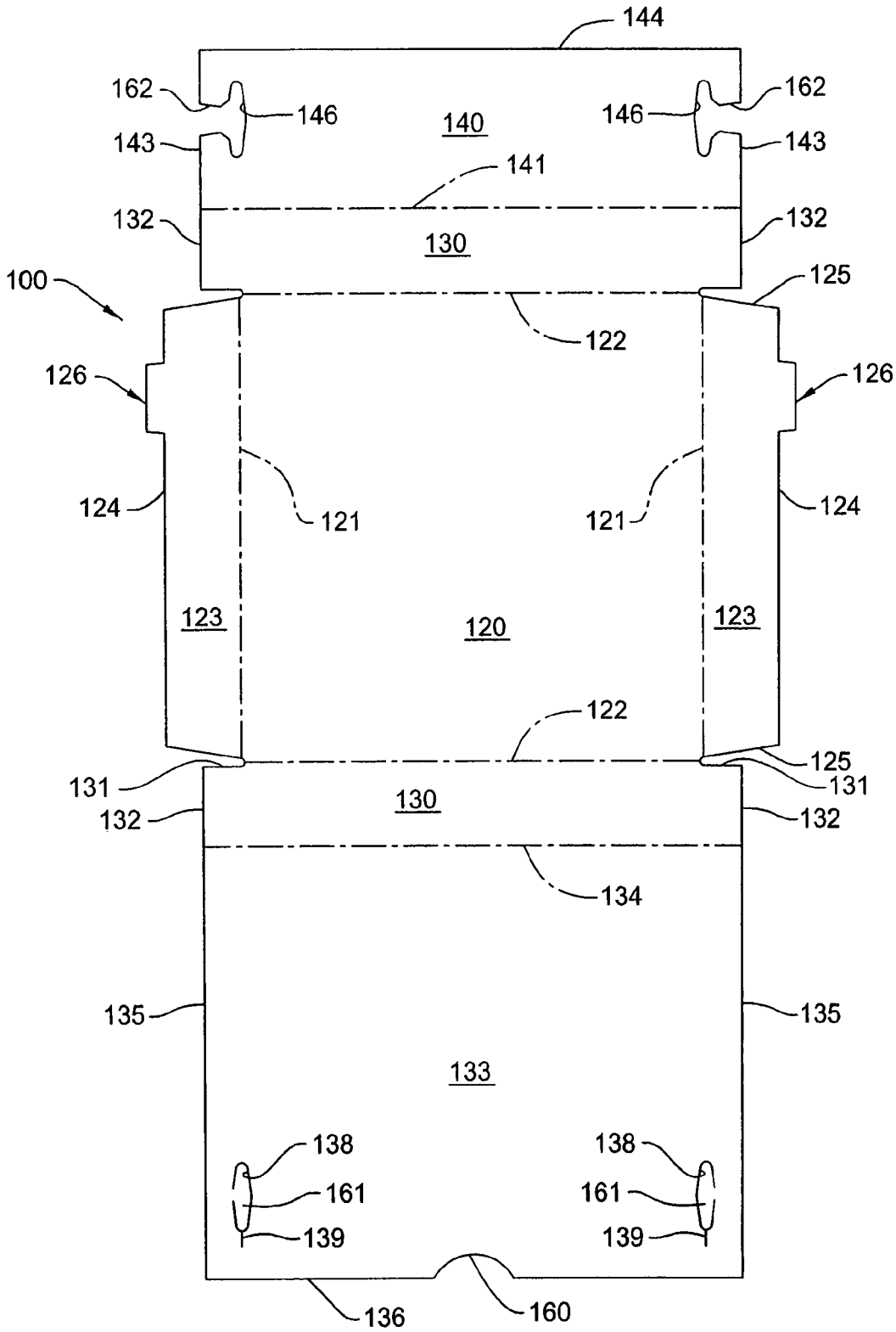
FIG. 6 is a plan view of an unfolded, flat, one-piece blank for preparing a container according to a further embodiment of the invention.

FIGS. 6-10 illustrate a further embodiment according to the present invention. This embodiment is generally similar to the above embodiment, and the same reference numbers, plus one-hundred, are accordingly utilized for the same or similar components. The blank 100 as shown in FIG. 6 is foldable into the shape of a container or box 113 (FIG. 10) suitable for carrying a food product, such as pizza.

With reference to FIG. 6, the top flap 133 of this embodiment has a significantly greater dimension, as defined between fold line 134 and free end edge 136, as compared to the dimension of the opposite top flap 140 defined between fold line 141 and free end edge 144. Further, top flap 133 defines therein a semi-circular and inwardly projecting cut-out 160 disposed approximately midway along end edge 136.

Top flap 133 additionally includes cut lines 138 which define elongated slots for receiving the respective tabs 126 of side walls 123. In this embodiment, cut lines 138 are not closed in configuration, and instead a flap 161 is formed which is pushed upwardly by the tab 126 of the respective side wall 123 when the container 113 is assembled. As with the prior embodiment, a straight cut or slot 139 extends outwardly from each cut line 138 towards end edge 136. The slots 139 serve to frictionally lock the top flap 133 in its closed position to prevent opening of the container 113 by gripping outermost portions of the respective tabs 126.

The opposite top flap 140 defines therein slots 146 which receive the respective tabs 126 of side walls 123 therein, in a similar manner to slots 46 of the first embodiment. In the instant embodiment, slots 146 have narrowed portions 162 which open sidewardly towards the respective side edges 143.

The blank 100 is assembled in a similar manner as blank 10 of the first embodiment, and thus the assembly of blank 100 will not be repeated here.

Figure 9:
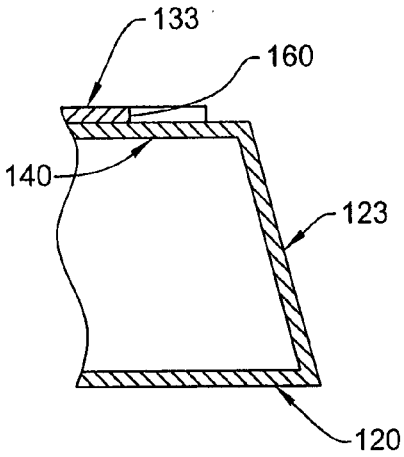
FIG. 9 is an enlarged, fragmentary and partial cross-sectional view taken generally along 9-9 in FIG. 7.
Figure 7:
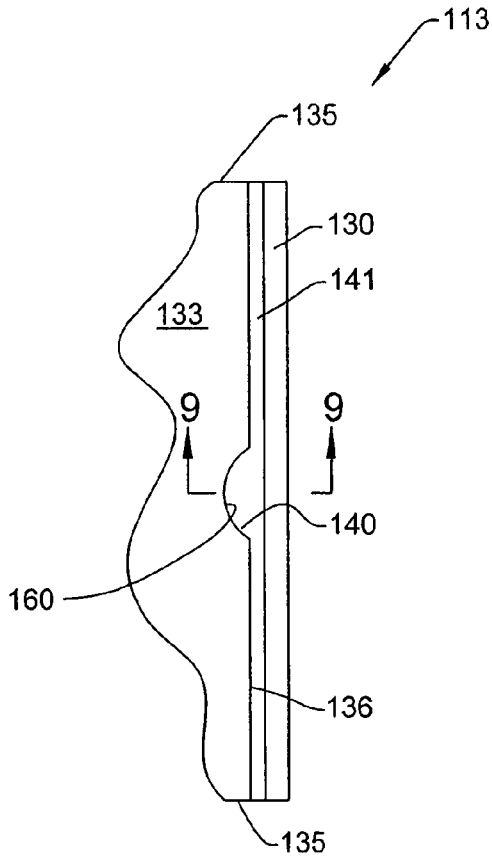
FIG. 7 is a fragmentary plan view of the container prepared from the blank of FIG. 6 in an assembled and closed configuration.
Figure 8:
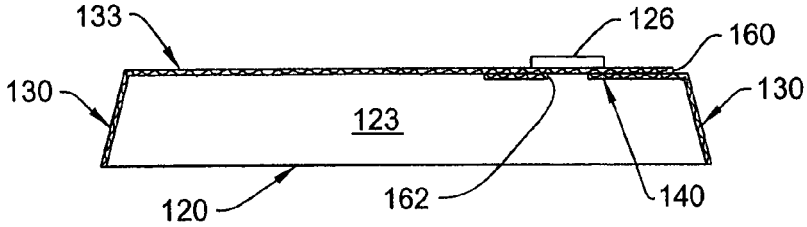
FIG. 8 is a side view of the assembled container prepared from the blank of FIG. 6.
Figure 10:
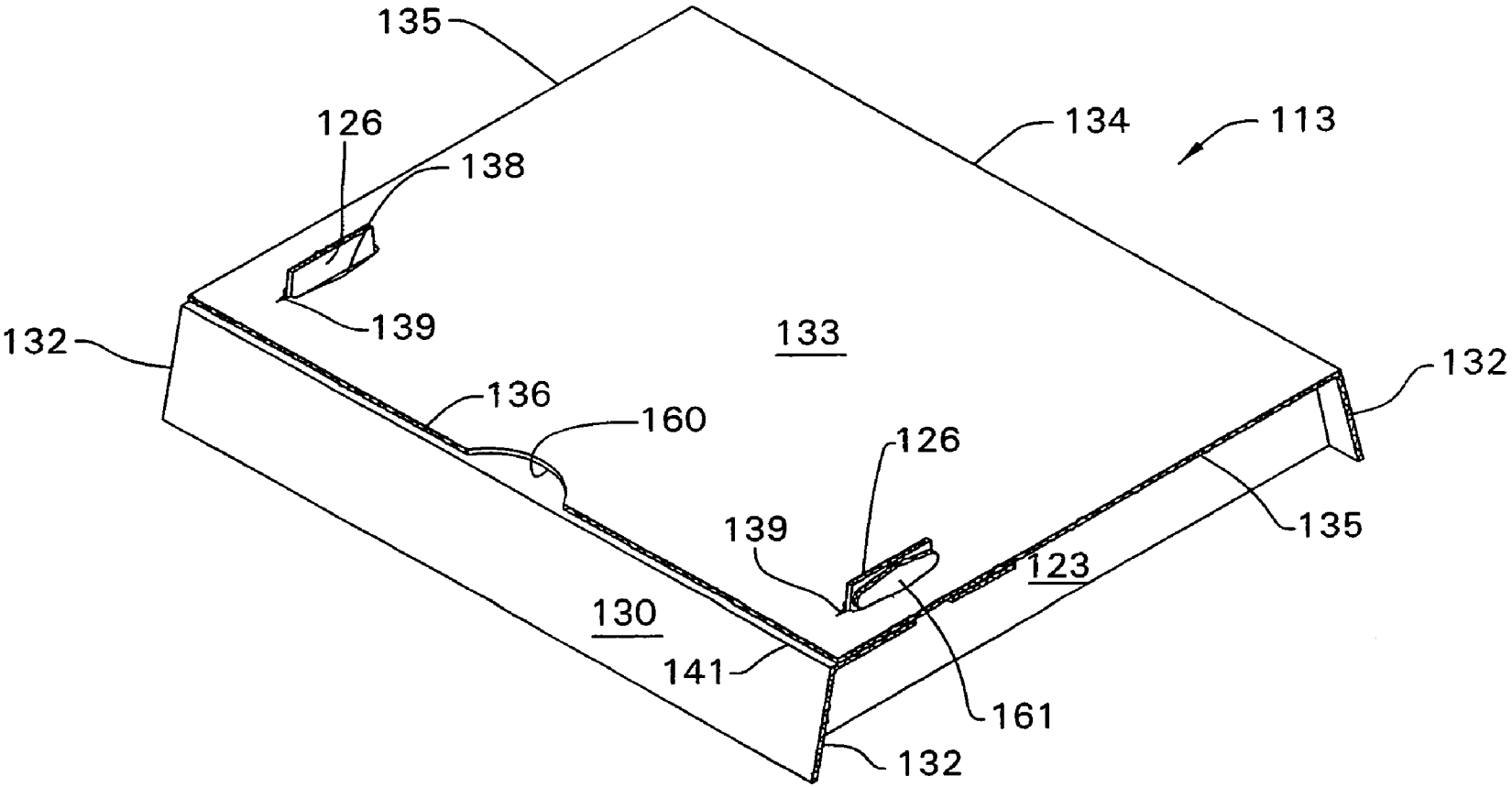
FIG. 10 is a perspective view of the container prepared from the blank of FIG. 6 in an assembled and closed configuration.

With reference to FIGS. 7-9, the top flap 133 is superimposed over the opposite top flap 140 in the assembled or folded configuration of blank 100, whereby the cut-out 160 is blocked off from below by a portion of top flap 140 disposed adjacent fold line 141. In this regard, cut-out 160 serves as a finger grip so as to assist the user/consumer in opening the container 113. That is, to open the container 113, a finger is placed into the cut-out 160 and under free edge 136 of top flap 133. Top flap 133 is then lifted upwardly so as to open the container 113 and gain access to the opposite top flap 140. The exposed top flap 140 is then lifted upwardly to fully open the container 113.

Although a particular embodiment has been disclosed in detail for illustrative purposes, it will be appreciated that variations or modifications of the disclosed apparatus, including the rearrangement of parts, lie within the scope of the present invention.

What is claimed is:

1. A food container comprising:

a generally planar bottom wall having a pair of first generally parallel side edges and a second pair of generally parallel side edges extending transversely relative to said first pair of side edges;

first and second side walls integrally joined to said bottom wall and folded upwardly therefrom about fold lines which extend along said first pair of side edges;

first and second end walls integrally joined to said bottom wall and folded upwardly therefrom about fold lines which extend along said second pair of side edges;

first and second generally planar top flaps, said first top flap being integrally joined to one of said end walls along a first fold line and folded downwardly from said one end wall about said first fold line, said second top flap being integrally joined to the other said end wall along a second fold line and folded downwardly from said other end wall about said second fold line so as to be positioned in superimposed relation with said first top flap; and a cut-out area defined generally along said first fold line, said second top flap defining a free edge portion disposed over a portion of said cut-out area adjacent said first fold line so as occlude said portion of said cut-out area from above and define a finger grip for opening said container.

2. The container of claim 1, wherein said free edge portion of said second top flap defines a terminal edge which is generally parallel to said first fold line, said terminal edge being disposed sidewardly outwardly from an inner edge of said cut-out area, said inner edge being disposed below said second top flap.

3. The container of claim 1, wherein said cut-out area is generally circular in configuration, and said first fold line generally bisects said cut-out area.

4. The container of claim 2, wherein said cut-out area is generally circular in configuration, and said first fold line generally bisects said cut-out area.

5. The container of claim 1, wherein said container includes at least one opening disposed generally along said second fold line to allow venting of heat within said container.

6. The container of claim 1, wherein said first and second top flaps and said first and second side walls together define a locking arrangement to maintain said first and second top flaps in a closed configuration.

7. A container comprising:

a generally horizontal bottom panel;

a pair of generally upright side walls which project upwardly from first opposite edges of said bottom panel;

a pair of generally upright end walls which project generally upwardly from second opposite edges of said bottom panel;

a top cover generally parallel to and spaced upwardly from said bottom panel, said top cover being defined by a pair of top flaps respectively joined to upper edges of the respective said end walls; and a cut-out area defined adjacent one of said end walls adjacent said upper edge thereof, one of said top flaps of said top cover having a free edge portion disposed in overlapping relation with a portion of said cutout area such that said cut-out area and said free edge portion together define a finger grip for opening said container, said cut-out area being disposed along a fold line which adjoins the other said top flap with said one end wall.

* * * * *